US007904012B2

(12) United States Patent
Kobashi et al.

(10) Patent No.: US 7,904,012 B2
(45) Date of Patent: Mar. 8, 2011

(54) IMAGE CARRIER CLEANING DEVICE, IMAGE CARRIER CLEANING METHOD, AND IMAGE FORMING APPARATUS

(75) Inventors: Masaru Kobashi, Matsumoto (JP); Yoichi Yamada, Shiojiri (JP); Masahiro Maeda, Matsumoto (JP); Atsunori Kitazawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 94 days.

(21) Appl. No.: 12/502,069

(22) Filed: Jul. 13, 2009

(65) Prior Publication Data

US 2010/0014901 A1 Jan. 21, 2010

(30) Foreign Application Priority Data

Jul. 16, 2008 (JP) ..... 2008-184829

(51) Int. Cl.
*G03G 21/00* (2006.01)

(52) U.S. Cl. ..... 399/343; 399/349; 399/350

(58) Field of Classification Search ..... 399/34, 399/71, 343, 346, 349, 350, 353, 354
See application file for complete search history.

(56) References Cited

U.S. PATENT DOCUMENTS

| | | | | |
|---|---|---|---|---|
| 5,850,974 | A | 12/1998 | Kettl et al. | 239/546 |
| 6,640,080 | B2 * | 10/2003 | Endo et al. | 399/349 |
| 7,171,151 | B2 * | 1/2007 | Endo et al. | 399/349 |

FOREIGN PATENT DOCUMENTS

| | | |
|---|---|---|
| JP | 04-275569 | 10/1992 |
| JP | 10-034031 | 2/1998 |
| JP | 2003-091142 | 3/2003 |
| JP | 2005-234247 | 9/2005 |
| JP | 2006-267510 | 10/2006 |

* cited by examiner

*Primary Examiner* — Hoang Ngo
(74) *Attorney, Agent, or Firm* — DLA Piper LLP (US)

(57) ABSTRACT

An image carrier cleaning device includes: a first charging member which charges an image carrier to the same polarity as that of a toner after a transfer operation of a toner image formed by the toner charged to a predetermined polarity and having an external additive added thereto; a cleaning member which comes into contact with the image carrier charged by the first charging member; and a second charging member which applies an electric charge having a polarity opposite to a polarity of the toner to the image carrier having passed through the cleaning member.

9 Claims, 4 Drawing Sheets

IMAGE CARRIER CLEANING DEVICE, IMAGE CARRIER CLEANING METHOD, AND IMAGE FORMING APPARATUS

BACKGROUND

1. Technical Field

The present invention relates to an image carrier cleaning device which removes residual non-transferred toner after a transfer operation of a toner image, an image carrier cleaning method, and an image forming apparatus including an electrophotographic device such as an electrostatic copy machine, a printer, or a facsimile provided with the image carrier cleaning device.

2. Related Art

Among image forming apparatuses, there is known an image forming apparatus disclosed in JP-A-H04-275569, where the image forming apparatus adopts a charging method in which a surface of a photoconductor is largely charged to a negative polarity by a charging brush after a transfer operation of a toner image and the photoconductor is adjusted to a predetermined negatively charged potential by means of a corona charging operation with a positive polarity using a corona charger in a rotation direction of the photoconductor from the charging brush. According to the charging method of the photoconductor, the amount of produced ozone can be reduced and the photoconductor can be uniformly charged.

However, a residual non-transferred toner and an external additive separated from the toner remain on the photoconductor after the transfer operation of the toner image. In the image forming apparatus disclosed in JP-A-H04-275569, when the residual non-transferred toner and the external additive are removed by a cleaning brush before arriving at the charging brush, the charging brush and the corona charger are prevented from being polluted, and hence a satisfactory charging operation can be continuously carried out.

However, when the residual non-transferred toner and the external additive after the transfer operation of the toner image are removed by the cleaning brush before the charging operation performed by the charging brush, an elevated portion may be formed between the photoconductor and an intermediate transfer belt. In addition, the intermediate transfer belt may be bent or the image may be omitted halfway due to the elevated portion. Particularly, in recent image forming apparatuses, toner having a small particle diameter of 5 μm or less and a high degree of circularity of 0.96 or more has been used for the purpose of obtaining a high definition. However, when such toner is used, the bending phenomenon or the image halfway omission may easily occur.

The reason is as below. That is, when the toner having a small particle diameter of 5 μm or less and a high degree of circularity of 0.96 or more is used, the residual non-transferred toner can easily exit the cleaning blade. For this reason, in order to reliably remove the residual non-transferred toner, a contact pressure applied from the cleaning blade to the photoconductor needs to be larger than that of the known image forming apparatus. However, if the contact pressure of the cleaning blade is large, an external additive is removed as well as the residual non-transferred toner. Additionally, if the external additive is excessively removed by the cleaning blade, most of the external additive exiting the cleaning blade and moving toward a transfer device is removed. For this reason, the elevated portion is easily formed between the photoconductor and the intermediate transfer belt, and hence the bending phenomenon or the image halfway omission occurs.

In addition, when the amount of the external additive exiting the cleaning blade is small, chattering or curling of the cleaning blade occurs due to a large contact pressure.

SUMMARY

An advantage of some aspects of the invention is that it provides an image forming apparatus, an image carrier cleaning method, and an image carrier cleaning device which further effectively removes a residual non-transferred toner remaining on an image carrier after a transfer operation of a toner image, prevents a bending phenomenon of an intermediate transfer belt and an image halfway omission, and suppresses chattering or curling of a cleaning member.

In order to achieve the above-described object, in the image carrier cleaning device, the image carrier cleaning method, and the image forming apparatus according to an aspect of the invention, the residual non-transferred toner and the external additive remaining on the image carrier after the transfer operation of the toner image are charged by a first charging member to the same polarity as that of the toner, so that an electrostatic adsorption force of the residual non-transferred toner and the external additive with respect to the image carrier is set to be large. Additionally, the residual non-transferred toner and the external additive having a large particle diameter are removed and collected by the cleaning member which comes into contact with the image carrier. Further, the external additive having a small particle diameter is allowed to exit the cleaning member by the use of the large electrostatic adsorption force.

Likewise, after the residual non-transferred toner and the external additive are charged by the first charging member, the residual non-transferred toner and the external additive having a large particle diameter can be reliably removed by the cleaning member and the external additive having a small particle diameter can exit the cleaning member. In addition, since the external additive having a small particle diameter exits the cleaning member, it is possible to effectively prevent the cleaning member from being chattered or curled due to the lubricating function of the external additive having a small particle diameter.

Further, the external additive having a small particle diameter exiting the cleaning member is charged by a second charging member to the polarity opposite to the polarity of the toner. Subsequently, at least a part of the external additive having a small particle diameter charged in this way is allowed to move toward a transfer device via an exposure device and a non-contact developing device at the next image forming operation. Subsequently, the external additive having a small particle diameter arriving at the transfer device is allowed to advance to the inside of the nip portion between the image carrier and an intermediate transfer medium. Accordingly, since it is possible to use the external additive having a small particle diameter as a lubricant, it is possible to prevent the elevated portion from being formed between the image carrier and the intermediate transfer medium. Thus, it is possible to prevent the intermediate transfer medium from being bent and to prevent the image from being omitted halfway.

Particularly, when a circumferential speed of the image carrier is set to be different from a circumferential speed of the intermediate transfer medium, the external additive having a small particle diameter advancing to the nip portion is capable of further effectively exhibiting the lubricating function.

Although the above-described elevated portion is easily formed when a fog amount of the toner is small, the above-described elevated portion can be effectively prevented even when the fog amount of the toner is small in such a manner that the external particle additive having a small particle diameter is allowed to actively advance to the nip portion. Accordingly, in the image forming apparatus according to another aspect of the invention, it is possible to suppress an amount of the consumed toner.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an exemplary embodiment of the invention will be described with reference to the accompanying drawings.

Figure 1:
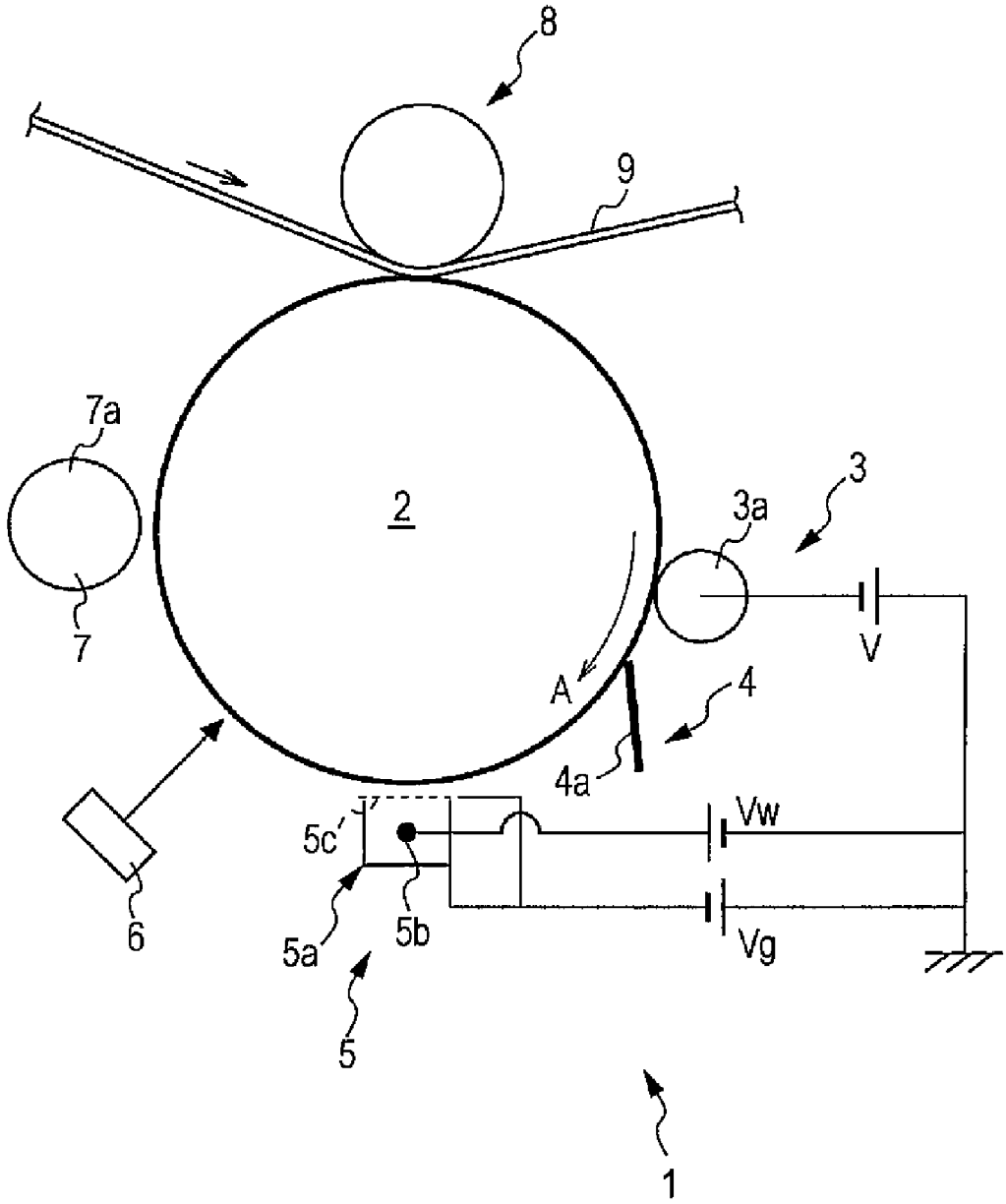
FIG. 1 is a diagram schematically and partially showing an image forming apparatus according to an example of an embodiment of the invention.

FIG. 1 is a diagram schematically and partially showing an image forming apparatus according to an example of an embodiment of the invention.

In an image forming apparatus 1 shown in the example, an image forming operation is carried out by a negatively charged toner. Of course, the image forming operation may be carried out by a positively charged toner. In the below description, the image forming apparatus 1 uses the negatively charged toner. However, in the case of the positively charged toner, the potential of the charging operation of each of the members to be described later may have the opposite polarity. In addition, the toner includes a toner mother particle and an external additive added to the toner mother particle, but in the below description, the toner mother particle is simply referred to as toner.

As shown in FIG. 1, the image forming apparatus 1 shown in the example includes a photoconductor 2 which is an image carrier used to form an electrostatic latent image and a toner image thereon. The photoconductor 2 is configured as a photoconductive drum. As in the known photoconductive drum, a photoconductive layer having a predetermined thickness is formed on the outer peripheral surface of a small metallic cylinder. As the small metallic cylinder of the photoconductor 2, for example, a conductive cylinder such as an aluminum cylinder is used. Also, as the photoconductive layer, a known organic photoconductor is used.

In the vicinity of the photoconductor 2, a first charger 3, a cleaning member 4, a second charger 5, an exposure device 6, a developing device 7, and a transfer device 8 are sequentially arranged in a rotation direction A (a clockwise direction in FIG. 1) of the photoconductor 2.

The first charger 3 is a roller charger having a rotatably installed charging roller 3*a* (corresponding to a first charging member according to the invention). The charging roller 3*a* is applied with a charging bias $V_1$ (V) of a negative polarity so as to perform a charging operation having the same polarity (i.e., a negative polarity) as that of the toner on the photoconductor 2 subjected to the transfer operation. As the charging roller 3*a*, a known charging brush roller or a known common charging rubber roller may be used.

The cleaning member 4 is a cleaning blade 4*a* (corresponding to a cleaning member according to the invention) which comes into contact with the photoconductor 2 having passed through the first charger 3. As the cleaning blade 4*a*, a known common cleaning blade may be used. In this case, a contact pressure applied from the cleaning blade 4*a* to the photoconductor 2 is set to be slightly higher than that of the known image forming apparatus in consideration of the negatively charged toner having a small particle diameter of 5 μm or less or a high degree of circularity of 0.96 or more. Accordingly, it is possible to prevent the toner particle having a small particle diameter or a high degree of circularity from exiting the cleaning blade 4*a*.

The second charger 5 is a corona charger 5*a* (corresponding to a second charging member according to the invention) which does not contact with the surface of the photoconductor 2. In detail, as the corona charger 5*a*, a scorotron charger is used. A wire charging bias Vw (V) of a positive direct current (DC) is applied to a charge wire 5*b* of the scorotron charger, and a grid charging bias Vg (V) of a negative direct current (DC) is applied to a grid 5*c*. Accordingly, when the corona charger 5*a* applies the electric charge of the positive polarity (which is opposite to the polarity of the toner) to the photoconductor 2 by using the corona discharge with the positive polarity, the potential of the surface of the photoconductor 2 decreases to be uniform, and the potential of the surface of the photoconductor is set to the potential of the negative polarity which is set during the image forming operation. At this time, the external additive having passed through the second charger 5 is charged to the positive polarity which is opposite to the negative polarity of the toner. Alternatively, the external additive which cannot be charged is set to about 0 V.

Additionally, in the image forming apparatus 1 shown in the example, the first charger 3, the cleaning member 4, and the second charger 5 constitute a cleaning device according to the invention.

As the exposure device 6, a known common exposure device may be used. In addition, the developing device 7 is a non-contact developing device in which the developing roller 7*a* does not contact with the photoconductor 2. As the developing device 7, a known common non-contact developing device may be used. Further, as the transfer device 8, a known common transfer device may be used. In this case, in a contact portion (nip portion) where the transfer device 8 comes into contact with the photoconductor 2 and an intermediate transfer belt, a circumferential speed of the photoconductor 2 is set to be different from a circumferential speed of the intermediate transfer belt 9 so as to prevent a backlash of a driving gear.

Next, an operation (including a cleaning method of the photoconductor 2) of the image forming apparatus 1 shown in the example will be described.

When the image forming operation of the image forming apparatus 1 starts, the photoconductor 2 rotates and the surface of the photoconductor 2 is uniformly charged by the corona charger 5*a* to the potential of the negative polarity which is set during the image forming operation. Subsequently, the surface of the photoconductor 2 is exposed to the light by means of the exposure device 6 so as to register an image thereon, and the electrostatic latent image having the reduced potential of the negative polarity is formed on the photoconductor 2. The electrostatic latent image formed on the photoconductor 2 is developed in a non-contact manner by the negatively charged toner of the developing roller 7*a* of the developing device 7, thereby forming the toner image on the photoconductor 2. The toner image formed on the photoconductor 2 is transferred onto the intermediate transfer belt 9 (corresponding to an intermediate transfer medium according to the invention) during the transfer operation performed by the transfer device 8. As in the known image forming apparatus, the toner image transferred onto the intermediate transfer belt 9 is transferred onto a transfer material such as a paper sheet by a second transfer device (not shown), and is fixed thereto by a fixing device, thereby forming the fixed image on the transfer material.

After the transfer operation ends, the residual non-transferred toner and the external additive remain on the photoconductor 2. The polarities of the residual non-transferred toner and the external additive are not uniform. Subsequently, by means of the charging roller 3*a* applied with the bias $V_1$ (V) of the negative polarity, the surface of the photoconductor 2 is charged to the negative polarity (a first charging operation). At this time, the residual non-transferred toner and the external additive remaining on the photoconductor 2 are simultaneously charged to the same polarity as that of the photoconductor 2. Accordingly, the electrostatic adsorption force of the residual non-transferred toner and the external additive with respect to the photoconductor 2 becomes large.

Even when the electrostatic adsorption force of the residual non-transferred toner and the external additive having a comparatively large particle diameter having passed through the charging roller 3*a* with respect to the photoconductor 2 becomes large, the residual non-transferred toner and the external additive are removed and collected from the photoconductor 2 by the cleaning blade 4*a* (a cleaning operation). However, when the electrostatic adsorption force of the external additive having a comparatively small particle diameter with respect to the photoconductor 2 is large, the external additive exits the cleaning blade 4*a*. This is obviously shown in, for example, the paragraph "0010" of JP-A-2006-267510. Likewise, since the external additive having a small particle diameter exits a gap between the photoconductor 2 and the cleaning blade 4*a*, chattering of the cleaning blade 4*a* is suppressed.

A portion of the photoconductor 2 arriving at the corona charger 5*a* is charged by the corona charger 5*a* to the same potential as the potential which is set during the image forming operation as described above (a second charging operation). Accordingly, the next image forming operation starts. At the same time, the external additive exiting the cleaning blade 4*a* is charged to the positive polarity which is opposite to the polarity of the negatively charged toner. In addition, the next image is registered on the photoconductor 2 by the exposure device 6 so as to form an electrostatic latent image thereon, and the electrostatic latent image is developed by the developing device 7, thereby forming a new negatively charged toner image thereon. At this time, the positively charged external additive having a small particle diameter moves in accordance with the rotation of the photoconductor 2, and passes through a gap between the photoconductor 2 and the developing roller 7*a* of the non-contact developing device. At this time, the external additive having a small particle diameter used in an image pattern having a large white area is not attracted toward the developing roller 7*a* due to the relationship of an electric field, but is attached to the photoconductor 2.

The new negatively charged toner image and the external additive having a small particle diameter move together toward the transfer device 8. Subsequently, the negatively charged toner image is transferred onto the intermediate transfer belt 9 by the transfer device 8. At this time, the external additive having a small particle diameter advances to the nip portion between the photoconductor 2 and the intermediate transfer belt 9. Accordingly, the external additive having a small particle diameter serves as a lubricant, thereby preventing an elevated portion from being formed between the photoconductor 2 and the intermediate transfer belt 9. Accordingly, it is possible to prevent the intermediate transfer belt 9 from being bent and to prevent the image from being omitted halfway. Particularly, in the image forming apparatus 1 shown in the example, since a circumferential speed of the photoconductor 2 is set to be different from a circumferential speed of the intermediate transfer belt 9, the external additive having a small particle diameter advanced to the nip portion further effectively exhibits a lubricating function. In addition, in the case of the image pattern having a large black area, the positively charged external additive having a small particle diameter can be attracted toward the developing roller 7*a*. However, since the new negatively charged toner having the external additive added from the developing roller 7*a* is developed, the new negatively charged toner attached onto the photoconductor 2 serves as a lubricant, thereby preventing an elevated portion from being formed between the photoconductor 2 and the intermediate transfer belt 9.

According to the cleaning device of the photoconductor 2, the cleaning method, and the image forming apparatus 1 shown in the example, the residual non-transferred toner and the external additive remaining on the photoconductor 2 after the transfer operation of the toner image are charged by the charging roller 3*a* to the negative polarity which is the same as that of the negatively charged toner, so that the electrostatic adsorption force of the residual non-transferred toner and the external additive with respect to the photoconductor 2 is set to be large. Additionally, the residual non-transferred toner and the external additive having a comparatively large particle diameter are removed and collected by the cleaning blade 4*a*. Further, the external additive having a comparatively small particle diameter is allowed to exit the cleaning blade 4*a*. At this time, since the electrostatic adoption force of the external additive having a small particle diameter with respect to the photoconductor 2 is set to be large, it is possible to allow the external additive having a small particle diameter to further reliably exit the cleaning blade 4*a*.

Likewise, after the residual non-transferred toner and the external additive are charged by the charging roller 3*a*, the residual non-transferred toner and the external additive having a comparatively large particle diameter can be reliably removed by the cleaning blade 4*a* and the external additive having a small particle diameter can exit the cleaning blade 4*a*. In addition, since the external additive having a small particle diameter exits the cleaning blade 4*a*, it is possible to effectively prevent the cleaning blade 4*a* from being chattered or curled by means of the lubricating function of the external additive having a small particle diameter.

The external additive having a small particle diameter exiting the cleaning blade 4*a* is charged by the corona charger 5*a* to the positive polarity. In addition, at least a part of the external additive having a small particle diameter charged to the positive polarity is allowed to move toward the transfer device 8 via the exposure device 6 and the developing device 7 at the next image forming operation. Subsequently, the external additive having a small particle diameter arriving at the transfer device 8 is allowed to actively advance to the inside of the nip portion between the photoconductor 2 and the intermediate transfer belt 9. Accordingly, since it is possible to use the external additive having a small particle diameter as a lubricant, it is possible to prevent an elevated portion from being formed between the photoconductor 2 and the intermediate transfer belt 9. Thus, it is possible to prevent the intermediate transfer belt 9 from being bent and to prevent the image from being omitted halfway. Particularly, in the image forming apparatus 1 shown in the example, since a circumferential speed of the photoconductor 2 is set to be different from a circumferential speed of the intermediate transfer belt 9, the external additive having a small particle diameter advancing to the nip portion is capable of further effectively exhibiting the lubricating function.

However, as in the image forming apparatus disclosed in JP-A-H04-275569, when the residual non-transferred toner after the transfer operation is first removed by the cleaning blade, an elevated portion may be formed between the photoconductor and the intermediate transfer belt. The elevated portion causes a problem in that the intermediate transfer belt is bent or the image is omitted halfway. This is because the residual non-transferred toner and the external additive are excessively removed by the cleaning blade. Accordingly, the external additive having a small particle diameter hardly advances to the nip portion between the photoconductor and the intermediate transfer belt. Particularly, when a fog amount of the toner is small, the elevated portion is easily formed.

Figure 2:
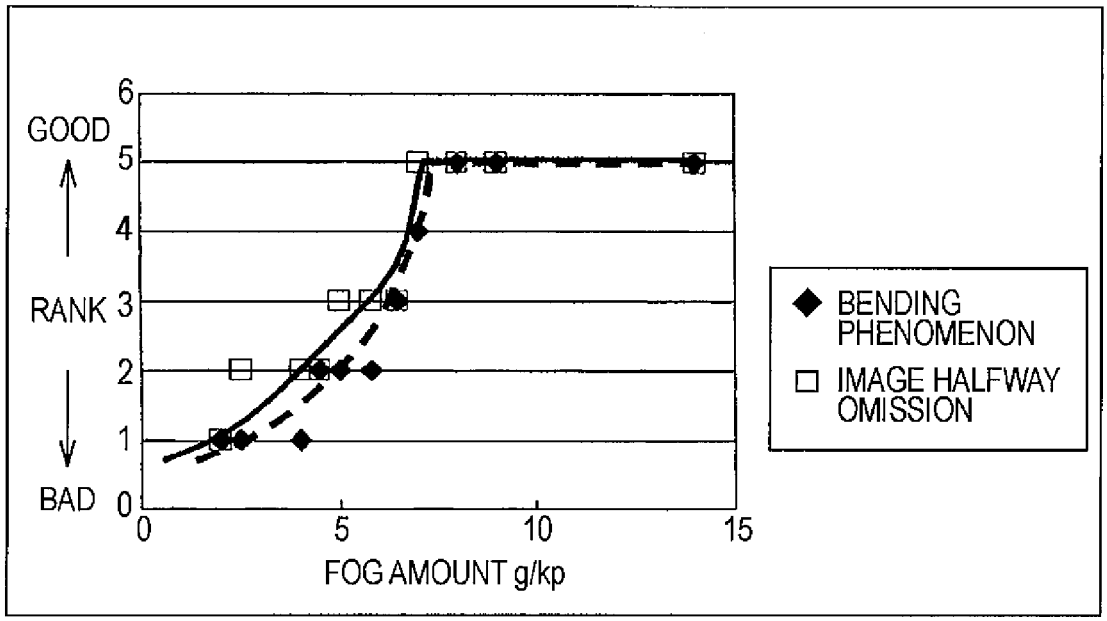
FIG. 2 is a diagram showing a relationship of a fog amount of the toner, a bending phenomenon, and an image halfway omission.

The relationship of the fog amount of the toner, the bending phenomenon, and the image halfway omission is obtained from the known various test results. As shown in FIG. 2, as the fog amount becomes less, the bending phenomenon and the image halfway omission more easily occur. When the fog amount exceeds a predetermined amount (about 7 g/kp), the bending phenomenon and the image halfway omission do not occur. This is because the external additive having a small particle diameter exiting the cleaning blade exists when the fog amount becomes large. Accordingly, the external additive advances to the nip portion between the photoconductor and the intermediate transfer belt. Thus, in the known image forming apparatus, the fog amount of the toner is set to be larger than a predetermined amount (about 7 g/kp) so as to have a region where the bending phenomenon and the image halfway omission hardly occur. For this reason, in the known image forming apparatus, an amount of the consumed toner is large.

On the contrary, in the image forming apparatus 1 shown in the example, the external additive having a small particle diameter further reliably exits the cleaning blade 4*a*, and a predetermined amount of the external additive having a small particle diameter is allowed to advance to the nip portion between the photoconductor 2 and the intermediate transfer belt 9. Accordingly, even when the fog amount of the toner is a predetermined amount (about 7 g/kp) or less, the bending phenomenon and the image halfway omission do not occur. Accordingly, in the image forming apparatus 1 shown in the example, it is possible to suppress an amount of the consumed toner.

Figure 3:
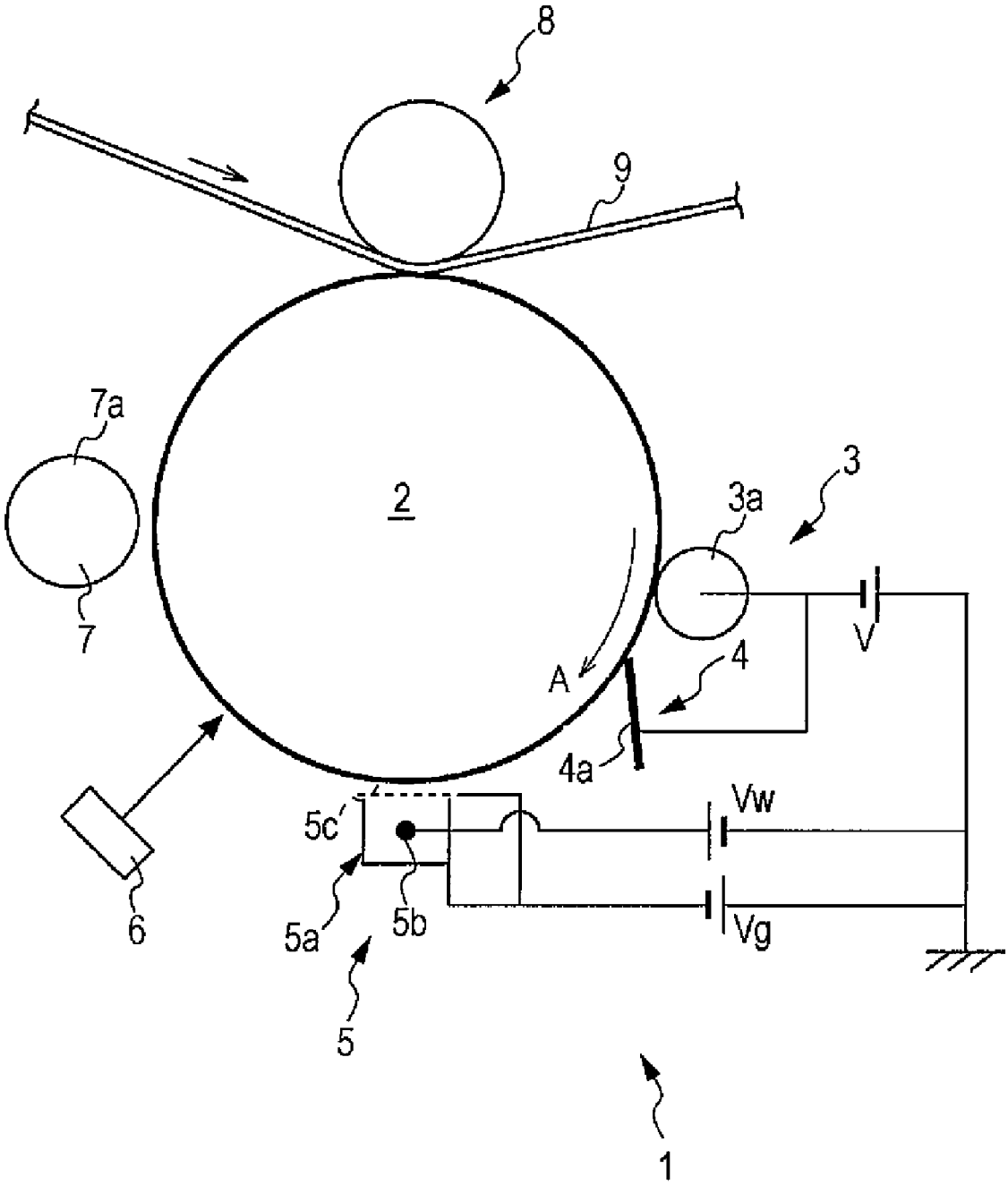
FIG. 3 is a diagram schematically and partially showing the image forming apparatus according to another example of the embodiment of the invention.

FIG. 3 is a diagram schematically and partially showing the image forming apparatus according to another example of the embodiment of the invention.

As shown in FIG. 3, in the image forming apparatus 1 shown in the example, the cleaning member 4 is a charging cleaning member. A bias of a negative polarity is applied to the cleaning blade 4*a*. Accordingly, the cleaning blade 4*a* is capable of performing a charging operation so that the external additive having a small particle diameter is further attached to the photoconductor 2. Thus, the external additive having a small particle diameter is capable of further effectively exiting the cleaning blade 4*a*.

Other configurations and advantages of the image forming apparatus 1 shown in the example are the same as those of the image forming apparatus shown in the example in FIG. 1.

Figure 4:
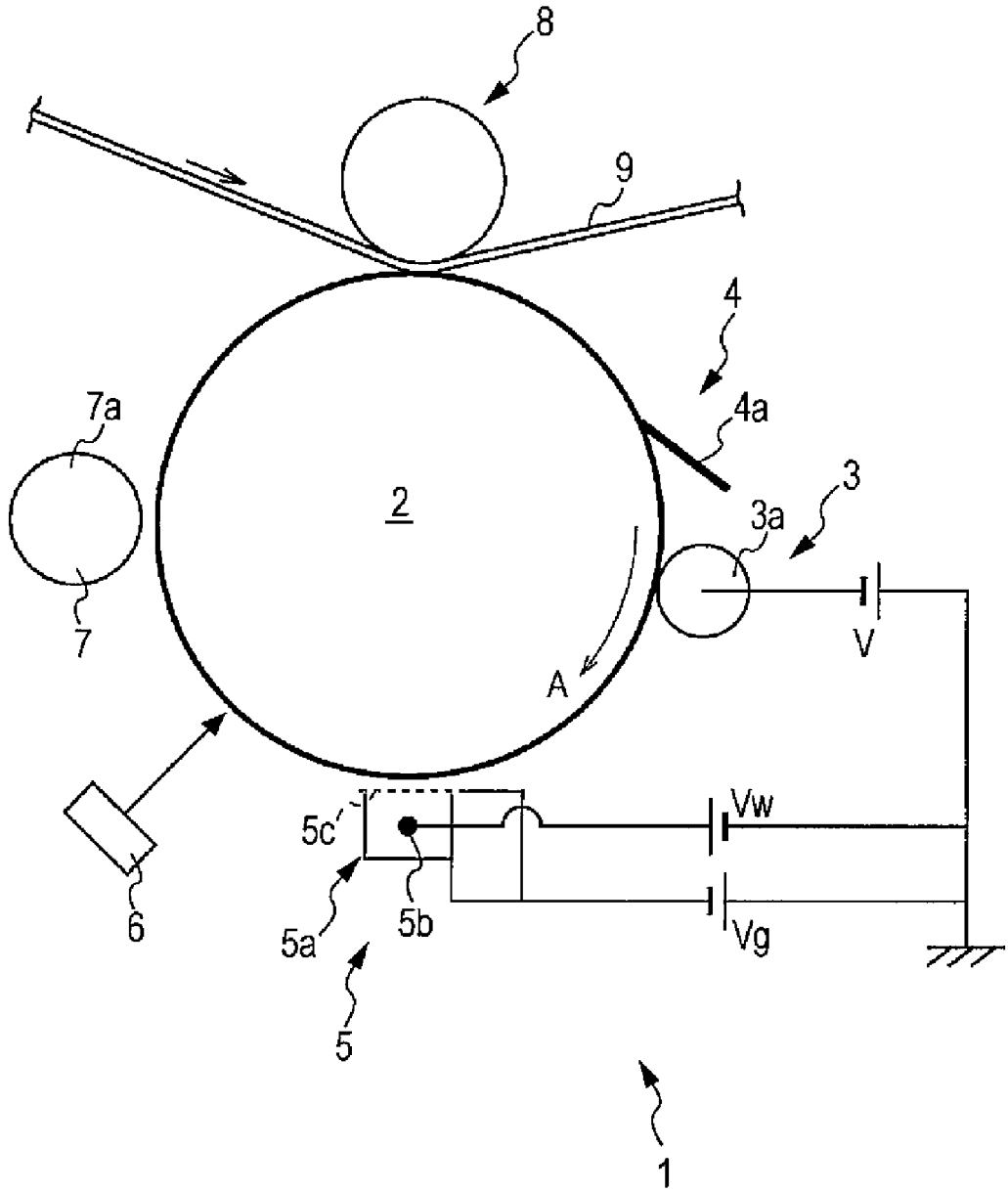
FIG. 4 is a diagram schematically and partially showing the image forming apparatus according to a comparative example.

Next, the cleaning device for the photoconductor 2 and the image forming apparatus 1 according to the invention will be described with reference to examples and comparative examples used for a test. The test was carried out by using a color printer LP9000C manufactured by Seiko Epson Corporation. In this case, only the cleaning device was modified as shown in FIGS. 1 and 4, and the color printer LP9000C was remodeled so as to mount the modified cleaning device thereto. The image forming apparatus 1 shown in FIG. 4 is a comparative example of the image forming apparatus 1. On the contrary to the image forming apparatus 1 shown in the example in FIG. 1, the cleaning member 4 is disposed between the transfer device 8 and the first charger 3. That is, the cleaning member 4 and the first charger 3 are arranged in a sequential order from the transfer device 8 along the rotation direction of the photoconductor 2. The operation conditions of the respective devices except for the cleaning device 4 are equal to the standard operation conditions for the color printer LP9000C.

First, the test of the bending phenomenon and the image halfway omission in the case of the changed fog amount of the toner will be described. The toner used in the test was a toner in which an external additive formed of silica by a HMDS process to have a volume average particle diameter of 12 nm is added to a toner mother particle formed of a polyester resin using a polymerization method to have a volume average particle diameter of 3 μm. In this case, only the fog amount of the toner was changed, and the other factors were uniformly maintained. The toner fog amounts and the test results according to the examples and the comparative examples are shown in Table 1. The evaluation of the bending phenomenon and the image halfway omission was carried out as below. That is, when the occurrences of the bending phenomenon and the image halfway omission were not visually observed, the evaluation result was marked as "good". When a slight occurrence of the bending phenomenon and the image halfway omission were visually observed, the evaluation result was marked as "no good". When significant occurrences of the bending phenomenon and the image halfway omission were visually observed, the evaluation result was marked as "bad".

TABLE 1

| | FOG AMOUNT (g/kp) | BENDING PHENOMENON | IMAGE HALFWAY OMISSION |
|---|---|---|---|
| EXAMPLE 1 | 2 | GOOD | GOOD |
| EXAMPLE 2 | 3 | GOOD | GOOD |
| EXAMPLE 3 | 5 | GOOD | GOOD |
| COMPARATIVE EXAMPLE 1 | 2 | BAD | BAD |
| COMPARATIVE EXAMPLE 2 | 5 | NO GOOD | BAD |
| COMPARATIVE EXAMPLE 3 | 8 | GOOD | NO GOOD |

As shown in Table 1, the fog amount is 2 g/kp in example 1, the fog amount is 3 g/kp in example 2, the fog amount is 5 g/kp in example 3, the fog amount is 2 g/kp in comparative example 1, the fog amount is 5 g/kp in comparative example 2, and the fog amount is 8 g/kp in comparative example 3. In the evaluation results of the bending phenomenon and the image halfway omission, the bending phenomenon and the image halfway omission were determined as "good" in examples 1 to 3, and the evaluation results of the bending phenomenon and the image halfway omission were determined as "no good" or "bad" in comparative examples 1 to 3.

Next, the test will be described for the occurrences of chattering of the cleaning blade, curling of the cleaning blade, the bending phenomenon, and the image halfway omission in the case of the changed volume average particle diameter of the toner and the changed degree of circularity. The toner used in the test was a toner in which an external additive formed of silica by a HMDS process and made to have a volume average particle diameter of 12 nm is added to a toner mother particle formed of a polyester resin using a polymerization method and a grinding method and made to have various volume average particle diameters and degrees of circularity to be described later. In this case, the volume average particle diameter and the degree of circularity of the toner mother particle were changed, and the other factors were uniformly maintained The volume average particle diameter and the degree of circularity of the toner and the test results according to the examples and the comparative examples are shown in Tables 2 and 3. Table 2 shows the case where the test is carried out by means of the image forming apparatus 1 shown in FIG. 1, and Table 3 shows the case where the test is carried out by means of the image forming apparatus 1 shown in FIG. 4. The evaluation of chattering of the cleaning blade, curling of the cleaning blade, the bending phenomenon, and the image halfway omission was carried out as below. That is, when the occurrences of chattering of the cleaning blade, curling of the cleaning blade, the bending phenomenon, and the image halfway omission were not visually observed, the evaluation result was marked as "good". When a slight occurrence of at least one of chattering of the cleaning blade, curling of the cleaning blade, the bending phenomenon, and the image halfway omission were visually observed, the evaluation result was marked as "no good". When the significant occurrence of at least one of chattering of the cleaning blade, curling of the cleaning blade, the bending phenomenon, and the image halfway omission were visually observed, the evaluation result was marked as "bad."

TABLE 2

| TONER | | DEGREE OF CIRCULARITY | | | | | | | |
|---|---|---|---|---|---|---|---|---|---|
| | | 0.91 | 0.92 | 0.93 | 0.94 | 0.95 | 0.96 | 0.97 | 0.98 |
| PARTICLE DIAMETER (μm) | 4 | | | | | | | GOOD | |
| | 4.5 | | | | | | | GOOD | |
| | 5 | | | GOOD | | | | | |
| | 5.5 | | | | | GOOD | GOOD | | |
| | 6 | | | | | | | | |
| | 6.5 | | | | | GOOD | | | |
| | 7 | | | GOOD | | | | GOOD | |
| | 7.5 | | | | | | | | |
| | 8 | | | | | | | | |
| | 8.5 | | GOOD | | | | | | |
| | 9 | | | | | | | | |

TABLE 3

| TONER | | DEGREE OF CIRCULARITY | | | | | | | |
|---|---|---|---|---|---|---|---|---|---|
| | | 0.91 | 0.92 | 0.93 | 0.94 | 0.95 | 0.96 | 0.97 | 0.98 |
| PARTICLE DIAMETER (μm) | 4 | | | | | | | BAD | |
| | 4.5 | | | | | | | BAD | |
| | 5 | | | BAD | | | | | |
| | 5.5 | | | | | GOOD | BAD | | |
| | 6 | | | | | | | | |
| | 6.5 | | | | | GOOD | | | |
| | 7 | | | GOOD | | | | BAD | |
| | 7.5 | | | | | | | | |
| | 8 | | | | | | | | |
| | 8.5 | | GOOD | | | | | | |
| | 9 | | | | | | | | |

As shown in Tables 2 and 3, the same toners were used in the examples and the comparative examples. That is, a polymerized toner was formed by a polymerization method to have a particle diameter of 4 μm and a degree of circularity of 0.97. A polymerized toner was formed by the polymerization method to have a particle diameter of 4.5 μm and a degree of circularity of 0.97. A polymerized toner was formed by the polymerization method to have a particle diameter of 5.5 μm and a degree of circularity of 0.95. A polymerized toner was formed by the polymerization method to have a particle diameter of 5.5 μm and a degree of circularity of 0.96. A polymerized toner was formed by the polymerization method to have a particle diameter of 6.5 μm and a degree of circularity of 0.95. A polymerized toner was formed by the polymerization method to have a particle diameter of 7 μm and a degree of circularity of 0.97. A grinded toner was formed by a grinding method to have a particle diameter of 5 μm and a degree of circularity of 0.93. A grinded toner was formed by a grinding method to have a particle diameter of 7 μm and a degree of circularity of 0.93. A grinded toner was formed by a grinding method to have a particle diameter of 8.5 μm and a degree of circularity of 0.92.

As shown in Tables 2 and 3, any toner in the examples was determined as "good". Additionally, the toners having a large particle diameter (larger than 5 μm) and a low degree of circularity (substantially lower than 0.96) in the comparative examples were determined as "good" as in the examples. However, the toners having a small particle diameter (5 μm or less) and a high degree of circularity (0.96 or more) were determined as "no good" or "bad". Based on the evaluation results, it is proven that there is a desired advantage obtained by the cleaning device according to the invention.

Further, the invention is not limited to the above-described examples, but may be modified into various forms in the scope described in claims.

The entire disclosure of Japanese Patent Application No. 2008-184829, filed Jul. 16, 2008 is expressly incorporated by reference herein.

What is claimed is:

1. An image carrier cleaning device comprising:

a first charging member which charges an image carrier to the same polarity as that of a toner after a transfer operation of a toner image formed by the toner charged to a predetermined polarity and having an external additive added thereto;

a cleaning member which comes into contact with the image carrier charged by the first charging member; and a second charging member which applies an electric charge having a polarity opposite to a polarity of the toner to the image carrier having passed through the cleaning member.

2. The image carrier cleaning device according to claim 1, wherein the first charging member is a charging roller.

3. The image carrier cleaning device according to claim 1, wherein the second charging member is a corona charger.

4. The image carrier cleaning device according to claim 1, wherein the cleaning member is a cleaning blade.

5. The image carrier cleaning device according to claim 1, wherein the cleaning member is a charging cleaning member which charges the image carrier to the same polarity as that of the first charging member.

6. An image forming apparatus comprising:

an image carrier which is configured to be rotatable and is used to form a latent image thereon;

an exposure device which registers the latent image on the image carrier;

a developing device which develops the latent image formed on the image carrier by means of a toner charged to a predetermined polarity and having an external additive added thereto;

a transfer device which transfers the toner image developed on the image carrier to an intermediate transfer medium; and the cleaning device according to claim 1, the cleaning device being used to remove a residual non-transferred toner remaining on the image carrier after the transfer operation of the toner image by means of a conductive member.

7. The image forming apparatus according to claim 6, wherein a volume average particle diameter of the toner is 5 μm or less.

8. The image forming apparatus according to claim 6, wherein in a contact portion between the image carrier and the intermediate transfer medium, a speed of the image carrier is set to be different from a speed of the intermediate transfer medium.

9. An image carrier cleaning method comprising:

a first charging step of charging an image carrier to the same polarity as that of a toner charged to a predetermined polarity after a transfer operation of a toner image;

a cleaning step of removing a residual non-transferred toner remaining on the image carrier after the transfer operation of the toner image by means of a cleaning member which comes into contact with the image carrier after the first charging step; and a second charging step of applying an electric charge, having a polarity opposite to a polarity of the toner, to the image carrier after the cleaning step.

* * * * *